US011810496B1

(12) United States Patent
Lin et al.

(10) Patent No.: US 11,810,496 B1
(45) Date of Patent: Nov. 7, 2023

(54) DISPLAY APPARATUS AND IMAGE DISPLAYING METHOD

(71) Applicant: AUO Corporation, Hsinchu (TW)

(72) Inventors: Chin-An Lin, Hsinchu (TW); Yi-Han Tseng, Hsinchu (TW); Jia-Long Wu, Hsinchu (TW); Yi-Ting Hsu, Hsinchu (TW); Kun-Cheng Tien, Hsinchu (TW)

(73) Assignee: AUO Corporation, Hsinchu (TW)

( * ) Notice: Subject to any disclaimer, the term of this patent is extended or adjusted under 35 U.S.C. 154(b) by 0 days.

(21) Appl. No.: 18/073,563

(22) Filed: Dec. 2, 2022

(30) Foreign Application Priority Data

Jul. 27, 2022 (TW) ..... 111128131

(51) Int. Cl.
*G09G 3/20* (2006.01)

(52) U.S. Cl.
CPC ... *G09G 3/2074* (2013.01); *G09G 2320/0276* (2013.01); *G09G 2320/0673* (2013.01)

(58) Field of Classification Search
CPC ..... G09G 3/2074; G09G 2320/0276; G09G 2320/0673
See application file for complete search history.

(56) References Cited

U.S. PATENT DOCUMENTS

| | | | |
|---|---|---|---|
| 8,208,683 | B2 | 6/2012 | Yamamoto et al. |
| 8,605,939 | B2 | 12/2013 | Yamamoto et al. |
| 8,620,018 | B2 | 12/2013 | Yamamoto et al. |
| 2006/0239501 | A1 | 10/2006 | Petrovic et al. |
| 2009/0052793 | A1 | 2/2009 | Huang et al. |
| 2009/0074242 | A1 | 3/2009 | Yamamoto et al. |
| 2012/0070032 | A1 | 3/2012 | Yamamoto et al. |
| 2012/0114168 | A1 | 5/2012 | Yamamoto et al. |
| 2015/0063626 | A1* | 3/2015 | Martin ..... H04N 1/32304 382/100 |
| 2015/0269362 | A1 | 9/2015 | Tehranchi et al. |
| 2022/0172663 | A1* | 6/2022 | Bogdanowicz ..... G09G 3/001 |

FOREIGN PATENT DOCUMENTS

| | | |
|---|---|---|
| CN | 1267999 | 9/2000 |
| CN | 101197913 | 6/2008 |
| CN | 101401429 | 4/2009 |
| CN | 101609546 | 12/2009 |
| CN | 102034218 | 4/2011 |
| CN | 106716483 | 5/2017 |
| CN | 110766594 | 2/2020 |
| CN | 111310134 | 6/2020 |

(Continued)

*Primary Examiner* — Adam R. Giesy
(74) *Attorney, Agent, or Firm* — JCIPRNET

(57) ABSTRACT

A display apparatus and an image displaying method are provided. The display apparatus includes a display module and a driving circuit. The driving circuit is coupled to the display module and receives an input image. The driving circuit determines a watermark area and a non-watermark area of the display module according to watermark information, and at least one of the watermark area and the non-watermark area is alternately driven by a first gamma curve and a second gamma curve. A brightness difference percentage between the first gamma curve and the second gamma curve at a same grayscale value between 10% and 90% of a grayscale percentage is between 0.2 and 0.6.

20 Claims, 13 Drawing Sheets

(56) References Cited

FOREIGN PATENT DOCUMENTS

| | | |
|---|---|---|
| EP | 1039414 | 9/2000 |
| EP | 3506250 | 7/2019 |
| EP | 3164849 | 5/2020 |
| TW | I335548 | 1/2011 |
| TW | I465956 | 12/2014 |
| WO | 2016025631 | 2/2016 |

* cited by examiner

| Combination | Frame | Watermark | | | Non-watermark | | |
|---|---|---|---|---|---|---|---|
| | | R1 | G1 | B1 | R2 | G2 | B2 |
| 1 | N | rA | rA | rA | rB | rB | rB |
| | N+1 | rB | rB | rB | rA | rA | rA |
| 2 | N | rA | rA | rB | rB | rB | rA |
| | N+1 | rB | rB | rA | rA | rA | rB |
| 3 | N | rA | rB | rA | rB | rA | rB |
| | N+1 | rB | rA | rB | rA | rB | rA |
| 4 | N | rA | rB | rB | rB | rA | rA |
| | N+1 | rB | rA | rA | rA | rB | rB |

| Combination | Frame | Watermark | | | Non-watermark | | |
|---|---|---|---|---|---|---|---|
| | | R1 | G1 | B1 | R2 | G2 | B2 |
| 1a | N | rA | rA | rA | rC | rC | rC |
| | N+1 | rB | rB | rB | rC | rC | rC |
| 2a | N | rA | rA | rB | rC | rC | rC |
| | N+1 | rB | rB | rA | rC | rC | rC |
| 3a | N | rA | rB | rA | rC | rC | rC |
| | N+1 | rB | rA | rB | rC | rC | rC |
| 4a | N | rA | rB | rB | rC | rC | rC |
| | N+1 | rB | rA | rA | rC | rC | rC |

FIG. 8

| Combination | Frame | Watermark | | | Non-watermark | | |
|---|---|---|---|---|---|---|---|
| | | R1 | G1 | B1 | R2 | G2 | B2 |
| 5 | N | rA | rA | rC | rC | rC | rC |
| | N+1 | rB | rB | rC | rC | rC | rC |
| 6 | N | rA | rB | rC | rC | rC | rC |
| | N+1 | rB | rA | rC | rC | rC | rC |

FIG. 9

| Combination | Frame | Watermark | | | Non-watermark | | |
|---|---|---|---|---|---|---|---|
| | | R1 | G1 | B1 | R2 | G2 | B2 |
| 1b | N | rA | rA | rA | rB | rB | rB |
| | N+1 | rB | rB | rB | rA | rA | rA |
| | N+2 | rD | rD | rD | rD | rD | rD |
| 2b | N | rA | rA | rB | rB | rB | rA |
| | N+1 | rB | rB | rA | rA | rA | rB |
| | N+2 | rD | rD | rD | rD | rD | rD |
| 3b | N | rA | rB | rA | rB | rA | rB |
| | N+1 | rB | rA | rB | rA | rB | rA |
| | N+2 | rD | rD | rD | rD | rD | rD |
| 4b | N | rA | rB | rB | rB | rA | rA |
| | N+1 | rB | rA | rA | rA | rB | rB |
| | N+2 | rD | rD | rD | rD | rD | rB |

| Combination | Frame | Watermark | | | Non-watermark | | |
|---|---|---|---|---|---|---|---|
| | | R1 | G1 | B1 | R2 | G2 | B2 |
| 1c | N | rA | rA | rA | rB | rB | rB |
| | N+1 | rB | rB | rB | rA | rA | rA |
| | N+2 | rB | rB | rB | rB | rB | rB |
| 2c | N | rA | rA | rB | rB | rB | rA |
| | N+1 | rB | rB | rA | rA | rA | rB |
| | N+2 | rB | rB | rB | rB | rB | rB |
| 3c | N | rA | rB | rA | rB | rA | rB |
| | N+1 | rB | rA | rB | rA | rB | rA |
| | N+2 | rB | rB | rB | rB | rB | rB |
| 4c | N | rA | rB | rB | rB | rA | rA |
| | N+1 | rB | rA | rA | rA | rB | rB |
| | N+2 | rB | rB | rB | rB | rB | rB |

FIG. 12

| Combination | Frame | Watermark | | | Non-watermark | | |
|---|---|---|---|---|---|---|---|
| | | R1 | G1 | B1 | R2 | G2 | B2 |
| 1d | N | rA | rA | rA | rC | rC | rC |
| | N+1 | rB | rB | rB | rC | rC | rC |
| | N+2 | rB | rB | rB | rC | rC | rC |
| 2d | N | rA | rA | rB | rC | rC | rC |
| | N+1 | rB | rB | rA | rC | rC | rC |
| | N+2 | rB | rB | rB | rC | rC | rC |
| 3d | N | rA | rB | rA | rC | rC | rC |
| | N+1 | rB | rA | rB | rC | rC | rC |
| | N+2 | rB | rB | rB | rC | rC | rC |
| 4d | N | rA | rB | rB | rC | rC | rC |
| | N+1 | rB | rA | rA | rC | rC | rC |
| | N+2 | rB | rB | rB | rC | rC | rC |

FIG. 13

| Combination | Frame | Watermark | | | Non-watermark | | |
|---|---|---|---|---|---|---|---|
| | | R1 | G1 | B1 | R2 | G2 | B2 |
| 5a | N | rA | rA | rC | rC | rC | rC |
| | N+1 | rB | rB | rC | rC | rC | rC |
| | N+2 | rB | rB | rC | rC | rC | rC |
| 6a | N | rA | rB | rC | rC | rC | rC |
| | N+1 | rB | rA | rC | rC | rC | rC |
| | N+2 | rB | rB | rC | rC | rC | rC |

FIG. 14

| Combination | Frame | Watermark | | |
|---|---|---|---|---|
| | | R1 | G1 | B1 |
| 1–1 | N | rA | rA | rA |
| | N+1 | rB | rB | rB |
| 2–1 | N | rA | rA | rB |
| | N+1 | rB | rB | rA |
| 3–1 | N | rA | rB | rA |
| | N+1 | rB | rA | rB |
| 4–1 | N | rA | rB | rB |
| | N+1 | rB | rA | rA |

| Combination | Frame | Non–watermark | | |
|---|---|---|---|---|
| | | R2 | G2 | B2 |
| 1–2 | M | rB | rB | rB |
| | M+1 | rA | rA | rA |
| 2–2 | M | rB | rB | rA |
| | M+1 | rA | rA | rB |
| 3–2 | M | rB | rA | rB |
| | M+1 | rA | rB | rA |
| 4–2 | M | rB | rA | rA |
| | M+1 | rA | rB | rB |

| a \ b | 1 | 2 | 3 | 4 | 5 |
|---|---|---|---|---|---|
| 1 | | | | | |
| 2 | 2 | 2 | | | |
| 3 | 3 | 6 | 3 | | |
| 4 | 4 | 4 | 12 | 4 | |
| 5 | 5 | 10 | 15 | 20 | 5 |

DISPLAY APPARATUS AND IMAGE DISPLAYING METHOD

CROSS-REFERENCE TO RELATED APPLICATION

This application claims the priority benefit of Taiwan application serial no. 111128131, filed on Jul. 27, 2022. The entirety of the above-mentioned patent application is hereby incorporated by reference herein and made a part of this specification.

BACKGROUND

Technical Field

The invention relates to a display apparatus, and more particularly, to a display apparatus displaying a watermark and an image displaying method thereof.

Description of Related Art

In confidential documents (such as paper documents or electronic documents), watermarks are usually added to warn users and to leave a clear mark when the confidential documents are copied. However, regarding traditional watermarks, when displayed information is similar to the watermark in hue/grayscale, it may hinder reading and cause discomfort in reading.

SUMMARY

The invention is directed to a display apparatus and an image displaying method, where when a confidential document is displayed, human eyes are insensitive to a watermark on the confidential document, but the watermark is obvious to photographic equipment.

The invention provides a display apparatus including a display module and a driving circuit. The driving circuit is coupled to the display module and receives an input image, and the driving circuit determines a watermark area and a non-watermark area of the display module according to watermark information. At least one of the watermark area and the non-watermark area is alternately driven by a first gamma curve and a second gamma curve. A luminance difference percentage between the first gamma curve and the second gamma curve at a same grayscale value between 10% and 90% of a grayscale percentage is between 0.2 and 0.6.

The invention provides an image displaying method of a display apparatus including following steps. An input image is received through a driving circuit of the display apparatus. A watermark area and a non-watermark area of a display module of the display apparatus are determined through the driving circuit according to watermark information. At least one of the watermark area and the non-watermark area is alternately driven by a first gamma curve and a second gamma curve through the driving circuit. A luminance difference percentage between the first gamma curve and the second gamma curve at a same grayscale value between 10% and 90% of a grayscale percentage is between 0.2 and 0.6.

Based on the above, in the display apparatus and the image displaying method according to the embodiments of the invention, at least one of the watermark area and the non-watermark area is driven alternately by the first gamma curve and the second gamma curve. The luminance difference percentage between the first gamma curve and the second gamma curve at the same grayscale value between 10% and 90% of the grayscale percentage is between 0.2 and 0.6. Since human eye perception is equivalent to a luminance integrator, the human eyes may view an image with an intermediate luminance, and photographic equipment with a fast shutter may obviously capture the image. In this way, the watermark to which the human eyes are insensitive but is clear to photographic equipment may be displayed on the display module.

In order for the aforementioned features and advantages of the disclosure to be more comprehensible, several embodiments accompanied with drawings are described in detail as follows.

BRIEF DESCRIPTION OF THE DRAWINGS

FIG. 8 is a schematic diagram of alternating driving combinations of gamma curves of a display apparatus according to an embodiment of the invention.

FIG. 9 is a schematic diagram of alternating driving combinations of gamma curves of a display apparatus according to an embodiment of the invention.

FIG. 12 is a schematic diagram of alternating driving combinations of gamma curves of a display apparatus according to an embodiment of the invention.

FIG. 13 is a schematic diagram of alternating driving combinations of gamma curves of a display apparatus according to an embodiment of the invention.

FIG. 14 is a schematic diagram of alternating driving combinations of gamma curves of a display apparatus according to an embodiment of the invention.

DESCRIPTION OF THE EMBODIMENTS

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It should be noted that although the terms "first", "second", "third", etc. may be used for describing various elements, components, regions, layers and/or portions, the elements, components, regions, layers and/or portions are not limited by these terms. These terms are only used for separating one element, component, region, layer or portion from another element, component, region, layer or portion. Therefore, the following discussed "first element", "component", "region", "layer" or "portion" may be referred to as the second element, component, region, layer or portion without departing from the scope of the invention.

The terminology used herein is for the purpose of describing particular embodiments and is not intended to be limiting of the invention. As used herein, the singular forms "a," "an" and "the" are intended to include the plural forms as well, unless the context clearly indicates otherwise. "or" represents "and/or". The term "and/or" used herein includes any or a combination of one or more of the associated listed items. It will be further understood that the terms "comprises," "comprising," "includes" and/or "including," when used herein, specify the presence of stated features, regions, integers, steps, operations, elements, and/or components, but do not preclude the presence or addition of one or more other features, regions, integers, steps, operations, elements, components, and/or groups thereof.

Figure 1:
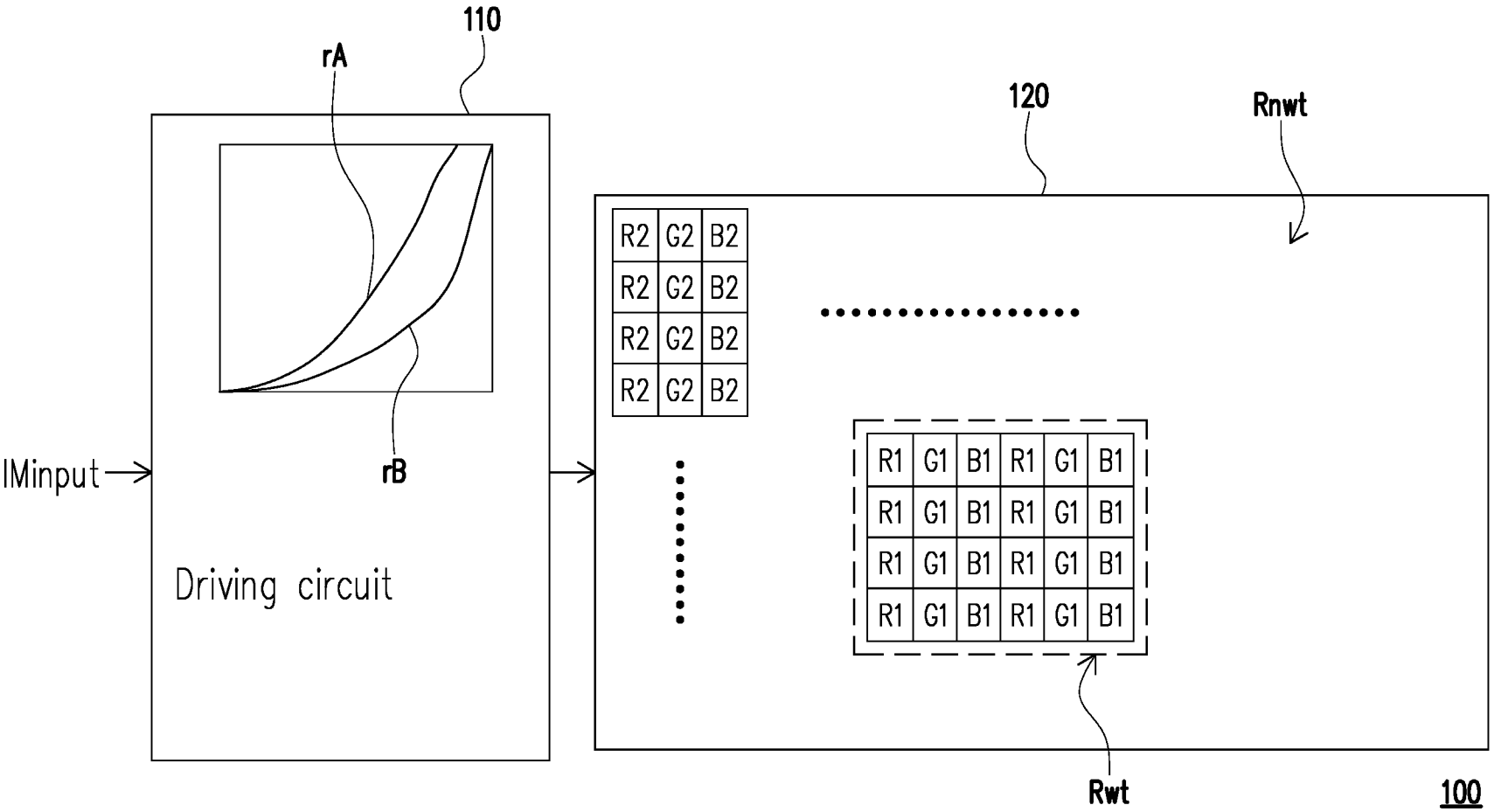
FIG. 1 is a system schematic diagram of a display apparatus according to an embodiment of the invention.

FIG. 1 is a system schematic diagram of a display apparatus according to an embodiment of the invention. Referring to FIG. 1, in the embodiment, a display apparatus 100 includes a driving circuit 110 and a display module 120. The driving circuit 110 is coupled to the display module 120 and receives an input image IMinput. The driving circuit 110 determines a watermark area Rwt and a non-watermark area Rnwt of the display module 120 according to watermark information, and at least one of the watermark area Rwt and the non-watermark area Rnwt is alternately driven by a first gamma curve rA and a second gamma curve rB. A luminance difference percentage between the first gamma curve rA and the second gamma curve rB at a same grayscale value between 10% and 90% of a grayscale percentage is between 0.2 and 0.6. The watermark information may be stored in the driving circuit 110, brought in by the input image IMinput, or input from the outside, but the embodiment of the invention is not limited thereto.

In the embodiment, when the watermark area Rwt is alternately driven by the first gamma curve rA and the second gamma curve rB, the non-watermark area Rnwt may be fixedly driven by another gamma curve (for example, a third gamma curve rC) different from the first gamma curve rA and the second gamma curve rB. Alternatively, when the watermark area Rwt is alternately driven by the first gamma curve rA and the second gamma curve rB, the non-watermark area Rnwt may be alternately driven by the second gamma curve rB and the first gamma curve rA.

Since human eye perception is equivalent to a luminance integrator, i.e., when a high-luminance image and a low-luminance image are switched at a high speed, human eyes may view an image with an intermediate luminance. However, a shutter speed of the photographic equipment is usually faster than a frame update rate of the display apparatus 100, so that the human eyes are not sensitive to a luminance difference between the gamma curves, but the photographic equipment may clearly capture the image. In other words, the human eyes are insensitive to the watermark area Rwt, but for the photographic equipment, the watermark area Rwt is noticeable. In this way, a watermark to which the human eyes are insensitive but is clear to photographic equipment may be displayed on the display module 120.

In the embodiment, the watermark area Rwt has a group formed by first red sub-pixels R1 (i.e., a first red sub-pixel group), a group formed by first green sub-pixels G1 (i.e., a first green sub-pixel group), and a group formed by first blue sub-pixels B1 (i.e., a first blue sub-pixel group), and the non-watermark area Rnwt has a group formed by second red sub-pixels R2 (i.e., a second red sub-pixel group), a group formed by second green sub-pixels G2 (i.e., a second green sub-pixel group), and a group formed by second blue sub-pixels B2 (i.e., a second blue sub-pixel group).

Figure 2:
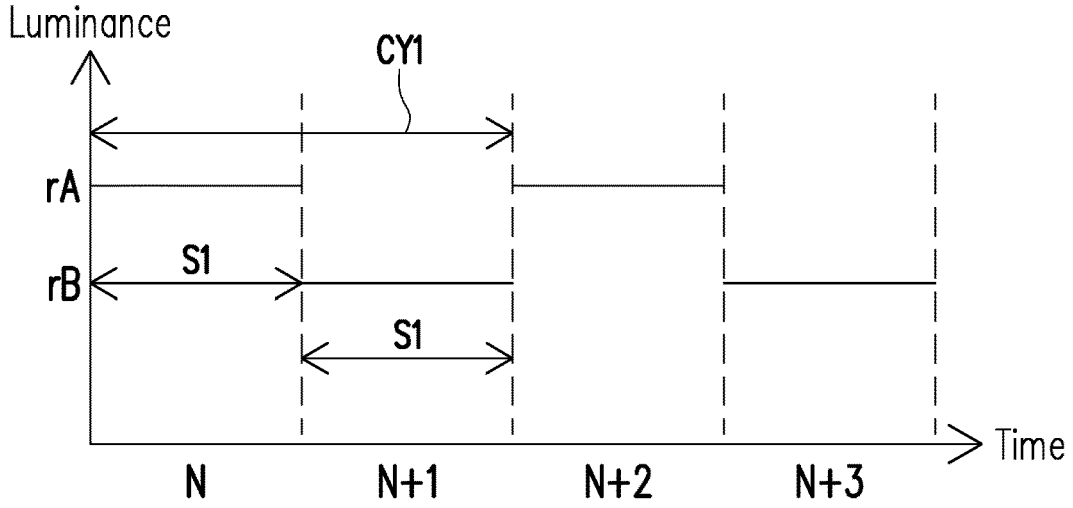
FIG. 2 is a schematic diagram of a driving timing of a display apparatus according to an embodiment of the invention.

FIG. 2 is a schematic diagram of a driving timing of the display apparatus according to an embodiment of the invention. Referring to FIG. 1 and FIG. 2, in the embodiment, multiple frame periods (i.e., a first frame N, a second frame N+1, a third frame N+2, and a fourth frame N+3 arranged in sequence) of the display apparatus 100 are shown, and as indicated by a cycle period CY1, the watermark area Rwt and/or the non-watermark area Rnwt are alternately driven by the first gamma curve rA and the second gamma curve rB in two frame periods (for example, the first frame N and the second frame N+1).

Since the first gamma curve rA and the second gamma curve rB have the luminance difference, if the frame update rate of the display apparatus is too low, the human eyes may feel flickering of a displayed frame. Therefore, in order to reduce the flickering feeling perceived by human eyes, a display time S1 of the first frame N and the second frame N+1 must be less than or equal to 1/80 second (i.e., 12.5 milliseconds (ms)).

In the embodiment of the invention, when both of the watermark area Rwt and the non-watermark area Rnwt are alternately driven by the first gamma curve rA and the second gamma curve rB, during the period of the first frame N, at least the group of the first red sub-pixels R1 in the group of the first red sub-pixels R1, the group of the first green sub-pixels G1, and the group of the first blue sub-pixels B1 is driven by the first gamma curve rA, and at least the group of the second red sub-pixels R2 in the group of the second red sub-pixels R2, the group of the second green sub-pixels G2, and the group of the second blue sub-pixels B2 is driven by the second gamma curve rB. During the period of the second frame N+1 following the first frame N, at least the group of the first red sub-pixels R1 in the group of the first red sub-pixels R1, the group of the first green sub-pixels G1, and the group of the first blue sub-pixels B1 is driven by the second gamma curve rB, and at least the group of the second red sub-pixels R2 in the group of the second red sub-pixels R2, the group of the second green sub-pixels G2, and the group of the second blue sub-pixels B2 is driven by the first gamma curve rA.

In the embodiment of the invention, the watermark area Rwt is alternately driven by the first gamma curve rA and the second gamma curve rB, and the non-watermark area Rnwt is driven by the third gamma curve rC. The third gamma curve rC is between the first gamma curve rA and the second gamma curve rB. Further, during the period of the first frame N, at least the group of the first red sub-pixels R1 in the group of the first red sub-pixels R1, the group of the first green sub-pixels G1, and the group of the first blue sub-pixels B1 is driven by the first gamma curve rA. Moreover, during the period of the second frame N+1 following the period of the first frame N, at least the group of the first red sub-pixels R1 in the group of the first red sub-pixels R1, the group of the first green sub-pixels G1, and the group of the first blue sub-pixels B1 is driven by the second gamma curve rB.

Figure 3:
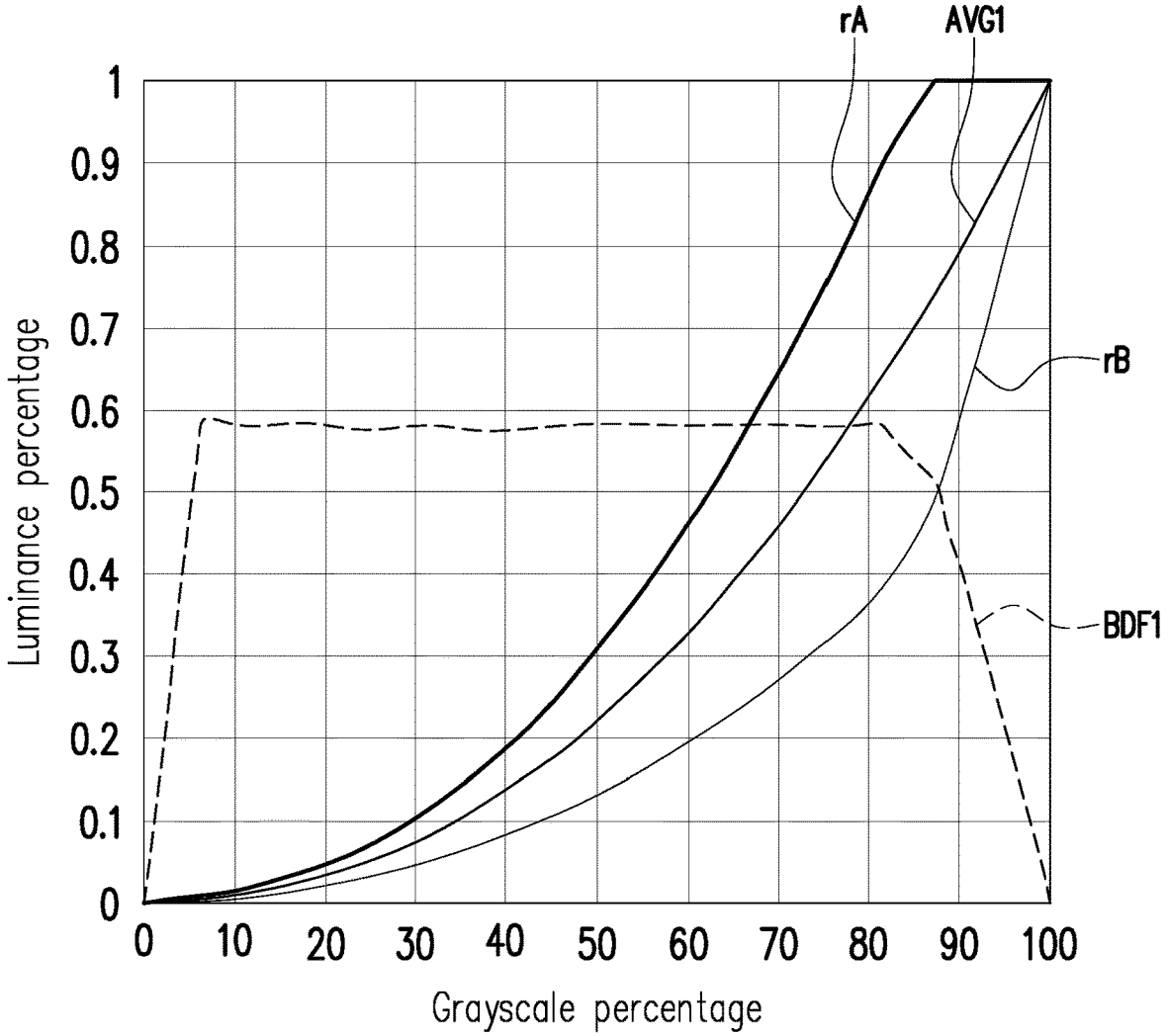
FIG. 3 is a schematic diagram of a gamma curve of a display apparatus according to an embodiment of the invention.

FIG. 3 is a schematic diagram of a gamma curve of a display apparatus according to an embodiment of the invention. Referring to FIG. 1 to FIG. 3, in the embodiment, FIG. 3 shows the first gamma curve rA, the second gamma curve rB, an average luminance curve AVG1, and a luminance difference curve BDF1. The average luminance curve AVG1=|(bA+bB)/2|, the luminance difference curve BDF1=|(bA−bB)/bA|, bA is a luminance value of the first gamma curve rA, and bB is a luminance value of the second gamma curve rB. As shown in the luminance difference curve BDF1, between 10% and 90% of the grayscale percentage, the luminance difference percentage between the first gamma curve rA and the second gamma curve rB at a same grayscale value is approximately between 0.5 and 0.6, since when the luminance difference percentage exceeds 20%, the watermark is obvious enough when the photographic equipment is used for shooting, and when the luminance difference percentage exceeds 60%, a profile of the watermark will be easily perceived by the human eyes due to insufficient pixel charging.

Figures 4, 5:
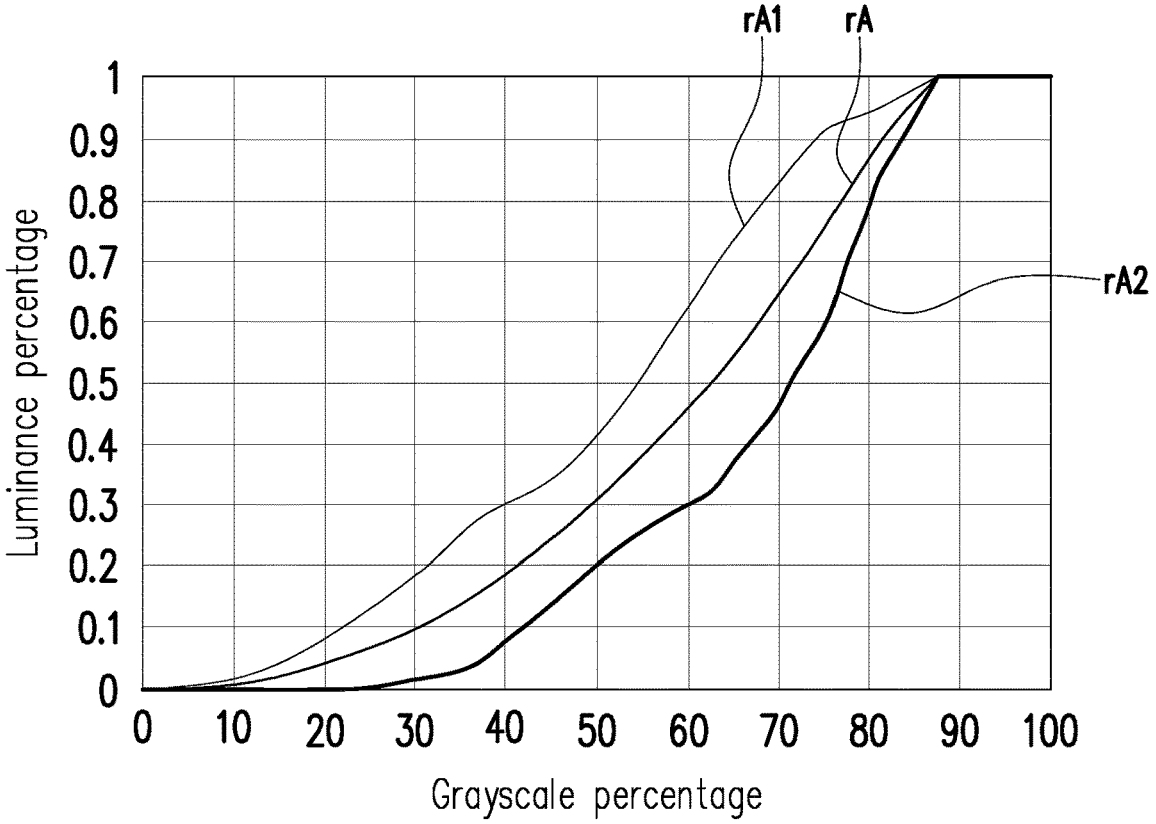
FIG. 4 is a schematic diagram of alternating driving combinations of gamma curves of a display apparatus according to an embodiment of the invention.
FIG. 5 is a schematic diagram of splitting a first gamma curve of a display apparatus according to an embodiment of the invention.

FIG. 4 is a schematic diagram of alternating driving combinations of the gamma curves of a display apparatus according to an embodiment of the invention. Referring to FIG. 1 to FIG. 4, in the embodiment, four alternating driving combinations are listed. Regarding a driving combination 1, during the period of the first frame N, the group of the first red sub-pixels R1, the group of the first green sub-pixels G1, and the group of the first blue sub-pixels B1 are driven by the first gamma curve rA, and the group of the second red sub-pixels R2, the group of the second green sub-pixels G2, and the group of the second blue sub-pixels B2 are driven by the second gamma curve rB. During the period of the second frame N+1, the group of the first red sub-pixels R1, the group of the first green sub-pixels G1, and the group of the first blue sub-pixels B1 are driven by the second gamma curve rB, and the group of the second red sub-pixels R2, the group of the second green sub-pixels G2, and the group of the second blue sub-pixels B2 are driven by the first gamma curve rA.

Regarding a driving combination 2, during the period of the first frame N, the group of the first red sub-pixels R1, the group of the first green sub-pixels G1, and the group of the second blue sub-pixels B2 are driven by the first gamma curve rA, and the group of the first blue sub-pixels B1, the group of the second red sub-pixels R2, and the group of the second green sub-pixels G2 are driven by the second gamma curve rB. During the period of the second frame N+1, the group of the first red sub-pixels R1, the group of the first green sub-pixels G1, and the group of the second blue sub-pixels B2 are driven by the second gamma curve rB, and the group of the first blue sub-pixels B1, the group of the second red sub-pixels R2, and the group of the second green sub-pixels G2 are driven by the first gamma curve rA.

Regarding a driving combination 3, during the period of the first frame N, the group of the first red sub-pixels R1, the group of the first blue sub-pixels B1, and the group of the second green sub-pixels G2 are driven by the first gamma curve rA, and the group of the first green sub-pixels G1, the group of the second red sub-pixels R2, and the group of the second blue sub-pixels B2 are driven by the second gamma curve rB. During the period of the second frame N+1, the group of the first red sub-pixels R1, the group of the first blue sub-pixels B1, and the group of the second green sub-pixels G2 are driven by the second gamma curve rB, and the group of the first green sub-pixels G1, the group of the second red sub-pixels R2, and the group of the second blue sub-pixels B2 are driven by the first gamma curve rA.

Regarding a driving combination 4, during the period of the first frame N, the group of the first red sub-pixels R1, the group of the second green sub-pixels G1, and the group of the second blue sub-pixels B2 are driven by the first gamma curve rA, and the group of the first green sub-pixels G1, the group of the first blue sub-pixels B1, and the group of the second red sub-pixels R2 are driven by the second gamma curve rB. During the period of the second frame N+1, the group of the first red sub-pixels R1, the group of the second green sub-pixels G2, and the group of the second blue sub-pixels B2 are driven by the second gamma curve rB, and the group of the first green sub-pixels G1, the group of the first blue sub-pixels B1, and the group of the second red sub-pixels R2 are driven by the first gamma curve rA.

FIG. 5 is a schematic diagram of splitting a first gamma curve of a display apparatus according to an embodiment of the invention. Referring to FIG. 2, FIG. 3 and FIG. 5, in the embodiment, the first gamma curve rA may be infinitely split into multiple gamma curves that are not equal to itself, such as gamma curves rA1 and rA2. In addition, the periods of the first frame N and the second frame N+1 are respectively divided into multiple sub-periods for corresponding to the split gamma curves (for example, rA1 and rA2), for example, a sum of luminance integrated over time in the individual sub-period=a sum of luminance integrated over time in the period of the first frame N/the second frame N+1.

Figure 6:
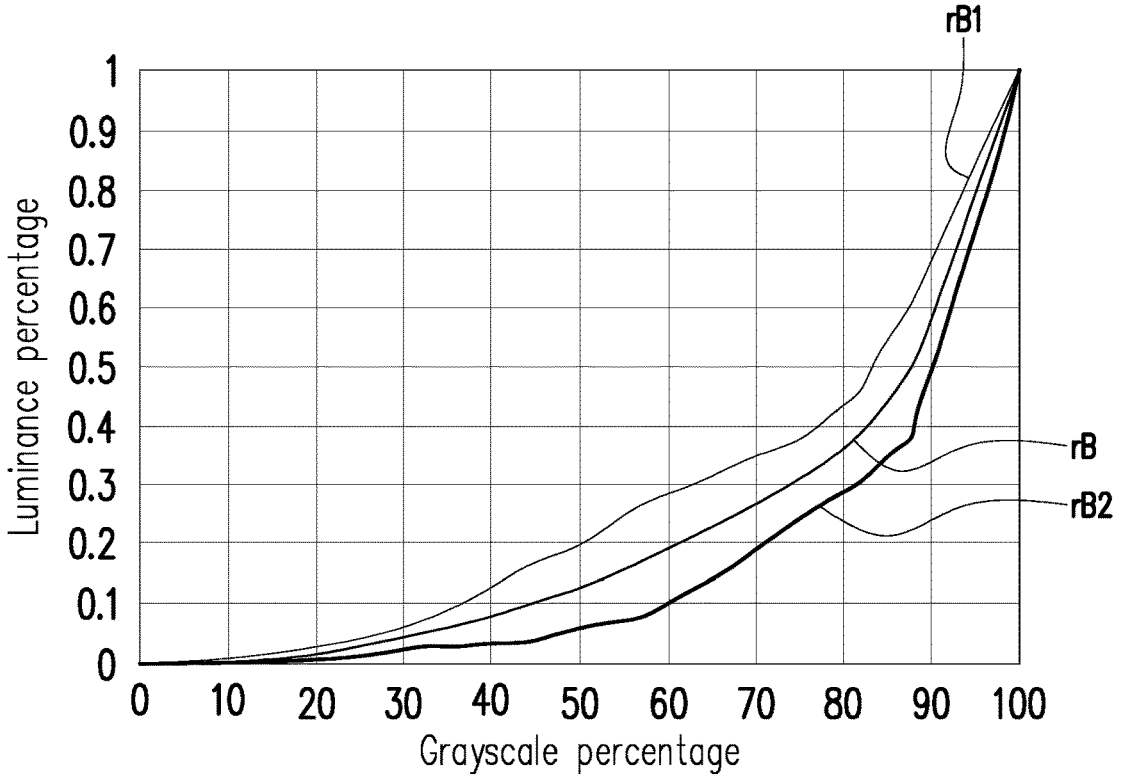
FIG. 6 is a schematic diagram of splitting a second gamma curve of a display apparatus according to an embodiment of the invention.

FIG. 6 is a schematic diagram of splitting a second gamma curve of a display apparatus according to an embodiment of the invention. Referring to FIG. 2, FIG. 3 and FIG. 6, in the embodiment, the second gamma curve rB may be infinitely divided into multiple gamma curves not equal to itself, such as gamma curves rB1 and rB2. In addition, the periods of the first frame N and the second frame N+1 are respectively divided into the sub-periods for corresponding to the split gamma curves (for example, rB1 and rB2), for example, a sum of luminance integrated over time in the individual sub-period=a sum of luminance integrated over time in the period of the first frame N/the second frame N+1.

Figure 7:
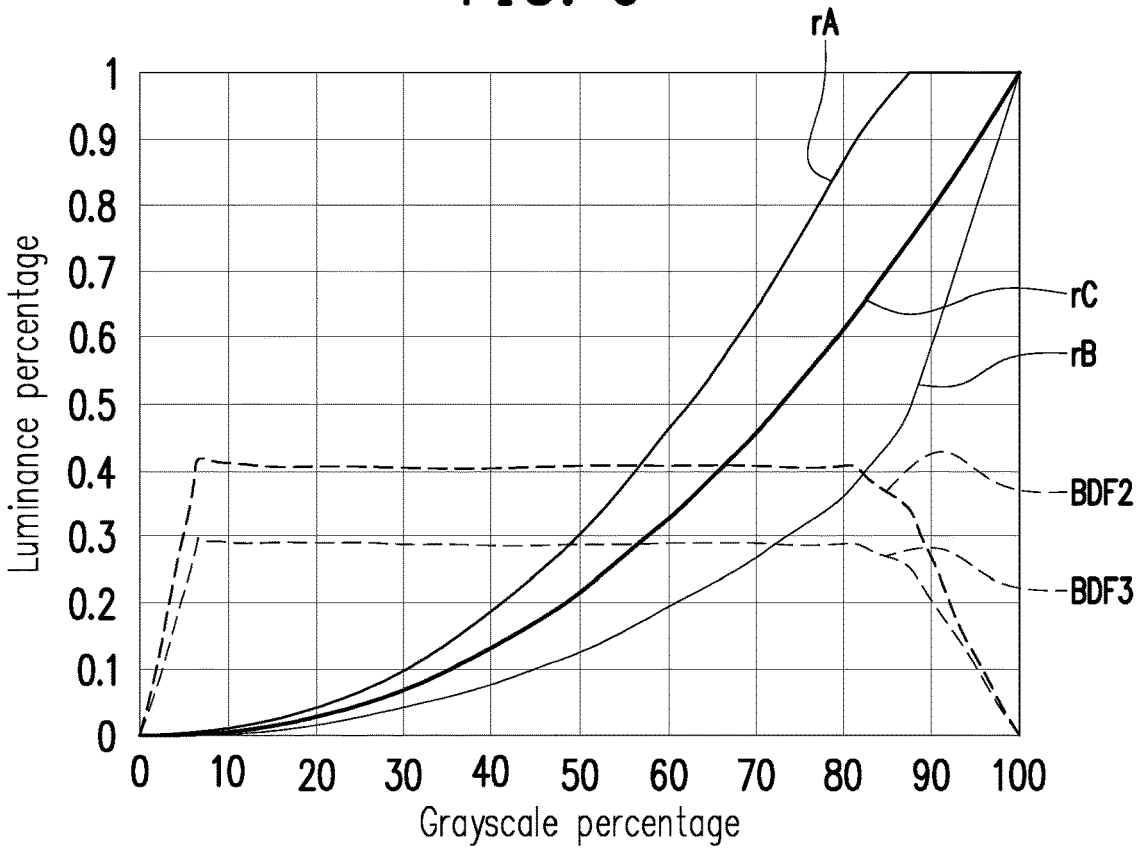
FIG. 7 is a schematic diagram of gamma curves of a display apparatus according to an embodiment of the invention.

FIG. 7 is a schematic diagram of gamma curves of a display apparatus according to an embodiment of the invention. Referring to FIG. 1 to FIG. 3 and FIG. 7, in the embodiment, the watermark area Rwt is alternately driven by the first gamma curve rA and the second gamma curve rB, and the non-watermark area Rnwt is driven by the third gamma curve rC. The third gamma curve rC is between the first gamma curve rA and the second gamma curve rB. The third gamma curve rC is approximately equal to an average luminance curve of the first gamma curve rA and the second gamma curve rB (shown as AVG1 in FIG. 3), and a luminance difference between the third gamma curve rC and the average luminance curve AVG1 is not more than 1.5%.

FIG. 7 shows the first gamma curve rA, the second gamma curve rB, the third gamma curve rC, and luminance difference curves BDF2, BDF3. The luminance difference curve BDF2=|(bA−bC)/bA|, the luminance difference curve BDF1=|(bC−bB)/bB|, bA is a luminance value of the first gamma curve rA, bB is a luminance value of the second gamma curve rB, and bC is a luminance value of the third gamma curve rC.

Shown as the luminance difference curve BDF2, between 10% and 90% of the grayscale percentage, a luminance difference percentage of the first gamma curve rA and the third gamma curve rC at a same grayscale value is approximately between 0.3 and 0.4. Shown as the luminance difference curve BDF3, between 10% and 90% of the grayscale percentage, a luminance difference percentage between the second gamma curve rB and the third gamma curve rC at the same grayscale value is approximately between 0.2 and 0.3.

In an embodiment of the invention, between 10% and 90% of the grayscale percentage, the luminance difference percentage between the first gamma curve rA and the third gamma curve rC at the same grayscale value is between 0.2 and 0.6. and the luminance difference percentage between the second gamma curve rB and the third gamma curve rC at the same grayscale value is between 0.2 and 0.6.

FIG. 8 is a schematic diagram of alternating driving combinations of the gamma curves of a display apparatus according to an embodiment of the invention. Referring to FIG. 1 to FIG. 4 and FIG. 7 to FIG. 8, in the embodiment, four alternating driving combinations are listed, which are similar to the four alternating driving combinations of FIG. 4. Regarding a driving combination 1*a*, during the period of the first frame N, the group of the first red sub-pixels R1, the group of the first green sub-pixels G1, and the group of the first blue sub-pixels B1 are driven by the first gamma curve rA, and during the period of the second frame N+1, the group of the first red sub-pixels R1, the group of the first green sub-pixels G1, and the group of the first blue sub-pixels B1 are driven by the second gamma curve rB. The group of the second red sub-pixels R2, the group of the second green sub-pixels G2, and the group of the second blue sub-pixels B2 are fixedly driven by the third gamma curve rC.

Regarding a driving combination 2*a*, during the period of the first frame N, the group of the first red sub-pixels R1, and the group of the first green sub-pixels G1 are driven by the first gamma curve rA, and the group of the first blue sub-pixels B1 is driven by the second gamma curve rB. During the period of the second frame N+1, the group of the first red sub-pixels R1, and the group of the first green sub-pixels G1 are driven by the second gamma curve rB, and the group of the first blue sub-pixels B1 is driven by the first gamma curve rA. The group of the second red sub-pixels R2, the group of the second green sub-pixels G2, and the group of the second blue sub-pixels B2 are fixedly driven by the third gamma curve rC.

Regarding a driving combination 3*a*, during the period of the first frame N, the group of the first red sub-pixels R1, and the group of the first blue sub-pixels B1 are driven by the first gamma curve rA, and the group of the first green sub-pixels G1 is driven by the second gamma curve rB. During the period of the second frame N+1, the group of the first red sub-pixels R1, and the group of the first blue sub-pixels B1 are driven by the second gamma curve rB, and the group of the first green sub-pixels G1 is driven by the first gamma curve rA. The group of the second red sub-pixels R2, the group of the second green sub-pixels G2, and the group of the second blue sub-pixels B2 are fixedly driven by the third gamma curve rC.

Regarding a driving combination 4*a*, during the period of the first frame N, the group of the first red sub-pixels R1 is driven by the first gamma curve rA, and the group of the first green sub-pixels G1, and the group of the first blue sub-pixels B1 are driven by the second gamma curve rB. During the period of the second frame N+1, the group of the first red sub-pixels R1 is driven by the second gamma curve rB, and the group of the first green sub-pixels G1, and the group of the first blue sub-pixels B1 are driven by the first gamma curve rA. The group of the second red sub-pixels R2, the group of the second green sub-pixels G2, and the group of the second blue sub-pixels B2 are fixedly driven by the third gamma curve rC.

FIG. 9 is a schematic diagram of alternating driving combinations of the gamma curves of a display apparatus according to an embodiment of the invention. Referring to FIG. 1 to FIG. 4 and FIG. 7 and FIG. 9, in the embodiment, two alternating driving combinations are listed. Regarding a driving combination 5, during the period of the first frame N, the group of the first red sub-pixels R1, and the group of the first green sub-pixels G1 are driven by the first gamma curve rA, and the group of the first blue sub-pixels B1 is driven by the third gamma curve rC. During the period of the second frame N+1, the group of the first red sub-pixels R1, and the group of the first green sub-pixels G1 are driven by the second gamma curve rB, and the group of the first blue sub-pixels B1 is driven by the third gamma curve rC. The group of the second red sub-pixels R2, the group of the second green sub-pixels G2, and the group of the second blue sub-pixels B2 are fixedly driven by the third gamma curve rC.

Regarding a driving combination 6, during the period of the first frame N, the group of the first red sub-pixels R1 is driven by the first gamma curve rA, the group of the first green sub-pixels G1 is driven by the second gamma curve rB, and the group of the first blue sub-pixels B1 is driven by the third gamma curve rC. During the period of the second frame N+1, the group of the first red sub-pixels R1 is driven by the second gamma curve rB, the group of the first green sub-pixels G1 is driven by the first gamma curve rB, and the group of the first blue sub-pixels B1 is driven by the third gamma curve rA. The group of the second red sub-pixels R2, the group of the second green sub-pixels G2, and the group of the second blue sub-pixels B2 are fixedly driven by the third gamma curve rC.

Figures 10, 11:
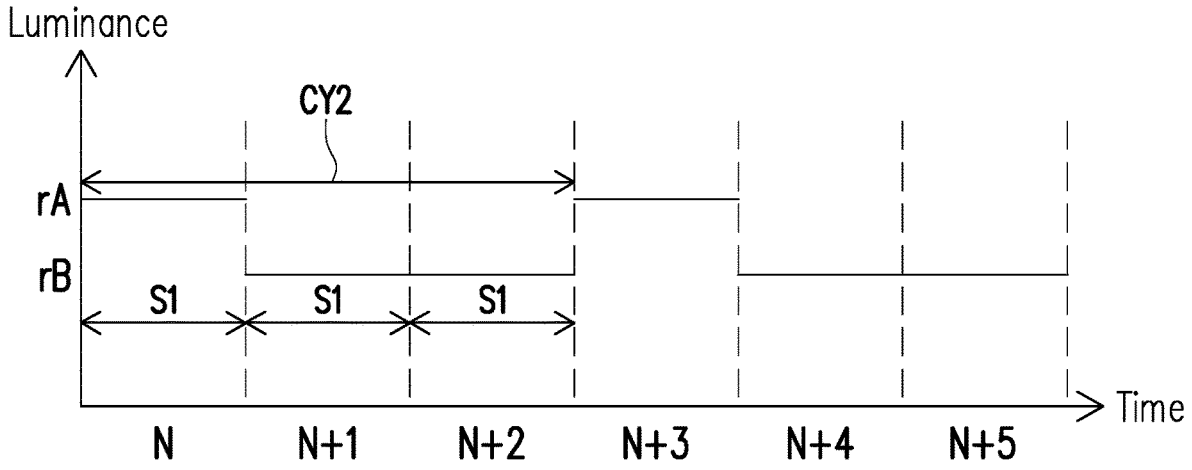
FIG. 10 is a schematic diagram of a driving timing of a display apparatus according to an embodiment of the invention.
FIG. 11 is a schematic diagram of alternating driving combinations of gamma curves of a display apparatus according to an embodiment of the invention.

FIG. 10 is a schematic diagram of a driving timing of a display apparatus according to an embodiment of the invention. Referring to FIG. 1, FIG. 2 and FIG. 10, in the embodiment, the frame periods (i.e., a first frame N, a second frame N+1, a third frame N+2, a fourth frame N+3, a fifth frame N+4, and a sixth frame N+5 arranged in sequence) of the display apparatus 100 are shown, and as indicated by a cycle period CY2, the watermark area Rwt and/or the non-watermark area Rnwt are alternately driven by the first gamma curve rA and the second gamma curve rB in three frame periods (for example, the first frame N, the second frame N+1 and the third frame N+2). A time length of the cycle period CY2 is, for example, 1/40 second, so as to reduce a phenomenon of frame flickering.

FIG. 11 is a schematic diagram of alternating driving combinations of the gamma curves of a display apparatus according to an embodiment of the invention. Referring to FIG. 1, FIG. 2, FIG. 4, FIG. 10 and FIG. 11, in the embodiment, four alternating driving combinations are listed, which are similar to the four alternating driving combinations of FIG. 4. A difference there between is that for the alternating driving combinations 1*b*, 2*b*, 3*b* and 4*b*, in the third frame N+2, the group of the first red sub-pixels R1, the group of the first green sub-pixels G1, the group of the first blue sub-pixels B1, the group of the second red sub-pixels R2, the group of the second green sub-pixels G2, and the group of the second blue sub-pixels B2 are all driven by a gamma curve rD. The gamma curve rD is between the first gamma curve rA and the second gamma curve rB, and time lengths S1 and S2 of the periods of the first frame N and the second frame N+1 are greater than or equal to a time length S3 of the period of the third frame N+2, and the time length S3 is greater than or equal to 0.

FIG. 12 is a schematic diagram of alternating driving combinations of the gamma curves of a display apparatus according to an embodiment of the invention. Referring to FIG. 1, FIG. 2, FIG. 4, FIG. 10 and FIG. 12, in the embodiment, four alternating driving combinations are listed, which are similar to the four alternating driving combinations of FIG. 4. A difference there between is that for alternating driving combinations 1*c*, 2*c*, 3*c* and 4*c*, in the third frame N+2, the group of the first red sub-pixels R1, the group of the first green sub-pixels G1, the group of the first blue sub-pixels B1, the group of the second red sub-pixels R2, the group of the second green sub-pixels G2, and the group of the second blue sub-pixels B2 are all driven by the second gamma curve rB. The time lengths S1 and S2 of the periods of the first frame N and the second frame N+1 are greater than or equal to the time length S3 of the period of the third frame N+2, and the time length S3 is greater than or equal to 0.

FIG. 13 is a schematic diagram of alternating driving combinations of the gamma curves of a display apparatus according to an embodiment of the invention. Referring to FIG. 1, FIG. 2, FIG. 8, FIG. 10 and FIG. 13, in the embodiment, four alternating driving combinations are listed, which are similar to the four alternating driving combinations of FIG. 8. A difference there between is that for alternating driving combinations 1*d*, 2*d*, 3*d* and 4*d*, in the third frame N+2, the group of the first red sub-pixels R1, the group of the first green sub-pixels G1, and the group of the first blue sub-pixels B1 are driven by the second gamma curve rB, and the group of the second red sub-pixels R2, the group of the second green sub-pixels G2, and the group of the second blue sub-pixels B2 are driven by the third gamma curve rC. The time lengths S1 and S2 of the periods of the first frame N and the second frame N+1 are equal to the time length S3 of the period of the third frame N+2.

FIG. 14 is a schematic diagram of alternating driving combinations of the gamma curves of a display apparatus according to an embodiment of the invention. Referring to FIG. 1, FIG. 2, FIG. 9, FIG. 10 and FIG. 14, in the embodiment, two alternating driving combinations are listed, which are similar to the two alternating driving combinations of FIG. 9. A difference there between is that for alternating driving combinations 5*a* and 6*a*, in the third frame N+2, the group of the first red sub-pixels R1 and the group of the first green sub-pixels G1 are driven by the second gamma curve rB, and the group of the first blue sub-pixels B1, the group of the second red sub-pixels R2, the group of the second green sub-pixels G2, and the group of the second blue sub-pixels B2 are driven by the third gamma curve rC. The time lengths S1 and S2 of the periods of the first frame N and the second frame N+1 are equal to the time length S3 of the period of the third frame N+2.

Figure 15:
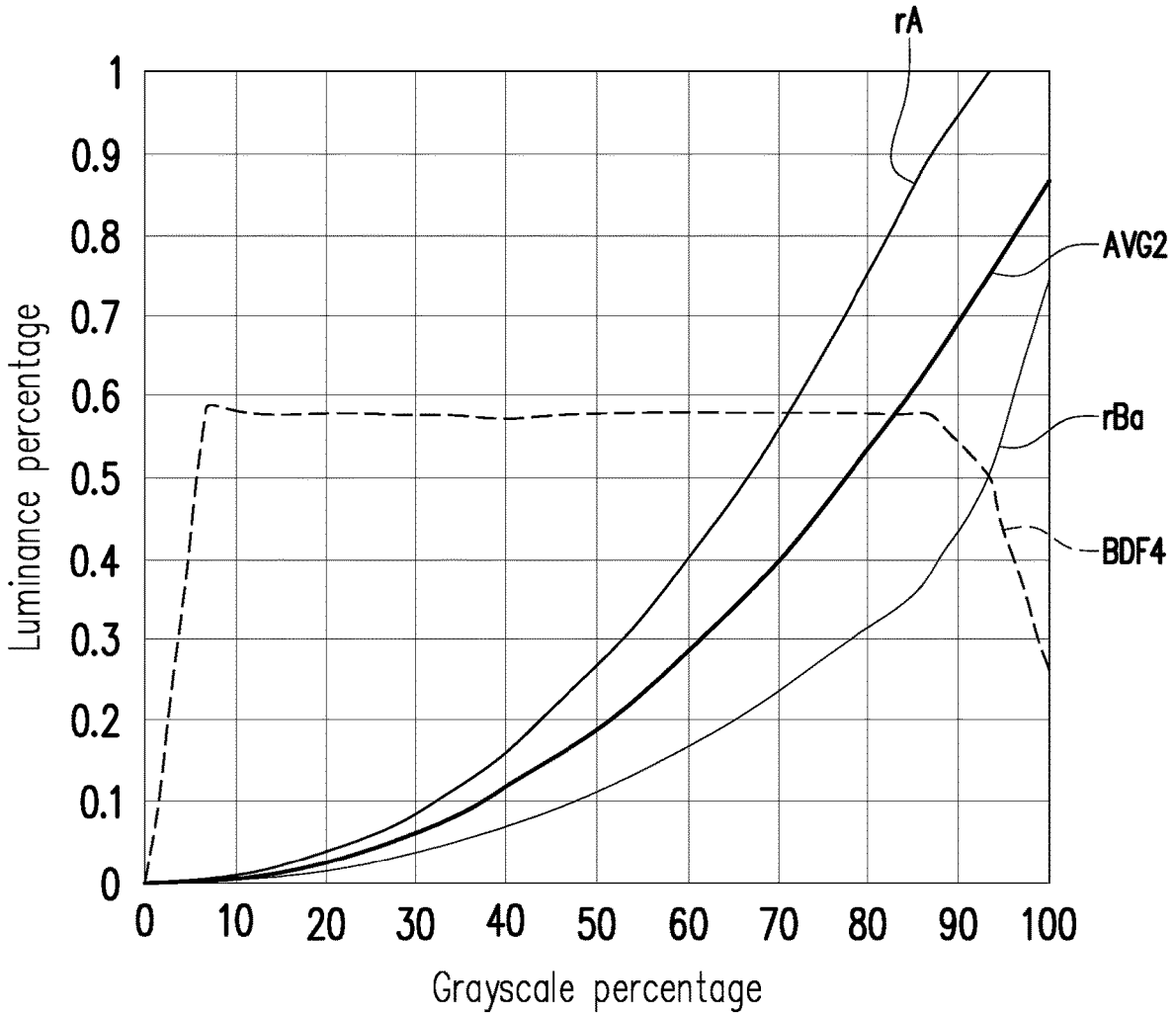
FIG. 15 is a schematic diagram of gamma curves of a display apparatus according to an embodiment of the invention.

FIG. 15 is a schematic diagram of gamma curves of a display apparatus according to an embodiment of the invention. Referring to FIG. 1, FIG. 3 and FIG. 15, as shown in FIG. 3, at a place where the grayscale percentage is greater than 90%, the luminance difference percentage between the first gamma curve rA and the second gamma curve rB is less than 20%, and the watermark captured by photographic equipment at high grayscales is inconspicuous, so that an effect of the watermark is weakened in applications with high grayscales and white backgrounds, such as document editing programs including word, pdf, ppt, etc. Therefore, as shown in FIG. 15, the first gamma curve rA and the second gamma curve rBa are not overlapped at the grayscale percentage of 100%, and the luminance difference percentage between the first gamma curve rA and the second gamma curve rBa at the grayscale percentage of 100% is about 0.3, shown as a luminance difference curve BDF4. In addition, FIG. 15 further shows an average luminance curve AVG2.

Figure 16:
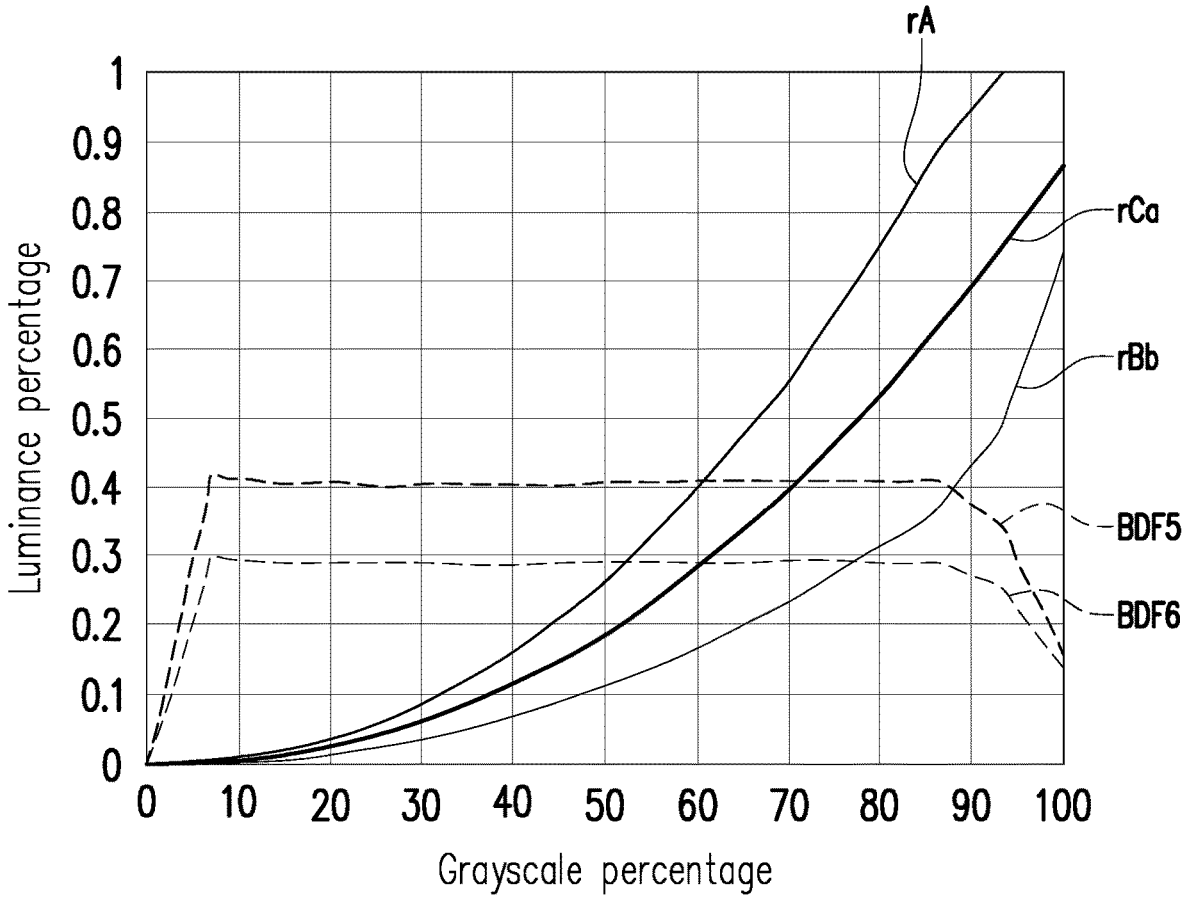
FIG. 16 is a schematic diagram of gamma curves of a display apparatus according to an embodiment of the invention.

FIG. 16 is a schematic diagram of gamma curves of a display apparatus according to an embodiment of the invention. Referring to FIG. 1, FIG. 7 and FIG. 16, as shown in FIG. 7, at a place where the grayscale percentage is greater than 90%, a luminance difference between the first gamma curve rA, the second gamma curve rB, and the third gamma curve rC may be less than 20%, so that the effect of the watermark is weakened in applications with high grayscales and white backgrounds. Therefore, as shown in FIG. 16, the first gamma curve rA, the second gamma curve rBb, and the third gamma curve rCa are not overlapped at the grayscale percentage of 100%, and as shown in luminance difference curves BDF5 and BDF6, a luminance difference percentage between the first gamma curve rA and the third gamma curve rCa at the grayscale percentage of 100% is about 0.15, and a luminance difference percentage between the second gamma curve rBa and the third gamma curve rCa at the grayscale percentage of 100% is about 0.15.

Figure 17:
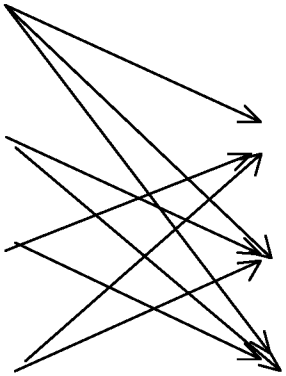
FIG. 17 is a schematic diagram of alternating driving combinations of gamma curves of a display apparatus according to an embodiment of the invention.

FIG. 17 is a schematic diagram of alternating driving combinations of gamma curves of a display apparatus according to an embodiment of the invention. Referring to FIG. 1 to FIG. 4 and FIG. 17, in the embodiment of FIG. 4, the difference in the amount of luminance is used to produce contrast, but it may produce larger flickering, which makes the eyes easy to fatigue. Especially, people with good dynamic vision are more likely to detect flickering, and the flickering is mainly contributed by the background, since the background area is large. Since the human eyes are more sensitive to a color difference than a luminance difference, by using a contrast of a hue difference to replace the contrast of the luminance difference, image flickering may be mitigated, and the effect of the hue difference generated by variation of blue on a color wheel is the greatest.

In the embodiment, the alternating driving combinations 1-4 are split into 1-1 to 4-1 (corresponding to the watermark area Rwt) and 1-2 to 4-2 (corresponding to the non-watermark area Rnwt), and the alternating driving combinations 1-1 to 4-1 may be individually matched with the alternating driving combinations 1-2 to 4-2, where N may be equal to M or M±1. In other words, the alternating driving combinations corresponding to the watermark area Rwt and the non-watermark area Rnwt may be complementary or non-complementary, which is not limited by the embodiment of the invention.

When the alternating driving combination 1-1 is matched with the alternating driving combination 1-2, a flickering value=53.7, a hue difference ΔE=12.12, and the luminance difference is the largest at this time; when the alternating driving combination 1-1 is matched with the alternating driving combination 2-2, the flickering value=42.9, the hue difference ΔE=60.24, and the contrast between the hue difference and the luminance difference is the best, and a degree of flickering is acceptable; when the alternating driving combination 1-1 is matched with the alternating driving combination 3-2, the flickering value=25.2, the hue difference ΔE=53.85, the contrast of the luminance difference (i.e., the flickering) at this time is the lowest, and the hue difference ΔE is the second highest; when the alternating driving combination 1-1 is matched with the alternating driving combination 4-2, the flickering value=37.2, and the hue difference ΔE=33.83. At this time, the flickering is in the middle, and the hue difference ΔE is the smallest. Taking the above combinations as an example, the alternating driving combination 1-1 matched with the alternating driving combination 2-2 have the best contrast value, and the alternating driving combination 1-1 matched with the alternating driving combination 3-2 have the lowest flickering value, so that the configuration of the alternating driving combinations depends on an objective of a circuit design, but the embodiment of the invention is not limited thereto.

Figures 18, 19:
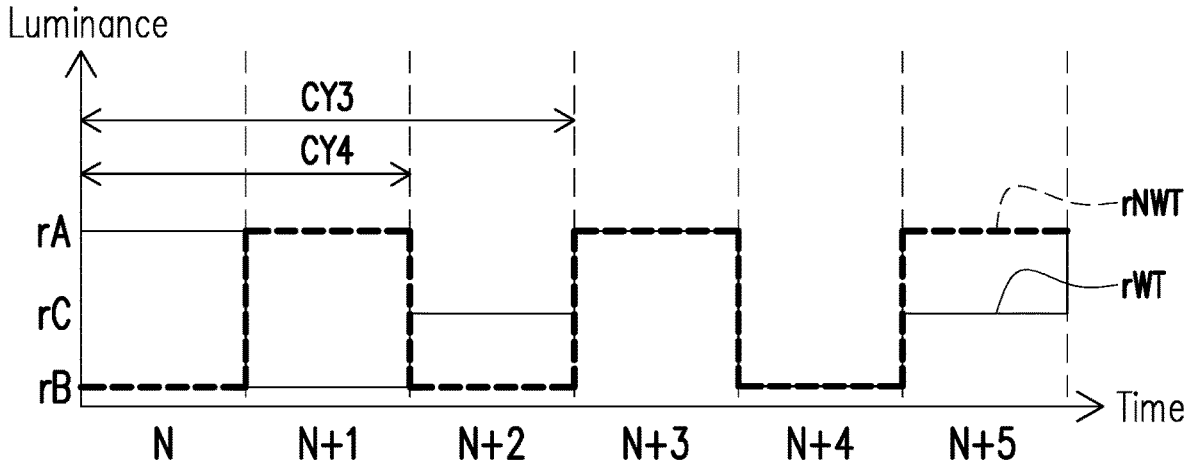
FIG. 18 is a schematic diagram of a driving timing of a display apparatus according to an embodiment of the invention.
FIG. 19 is a schematic diagram illustrating selection of asynchronous cycles of a watermark area and a non-watermark area of a display apparatus according to an embodiment of the invention.

FIG. 18 is a schematic diagram of a driving timing of a display apparatus according to an embodiment of the invention. Referring to FIG. 1 and FIG. 18, in the embodiment, the frame periods (i.e., the first frame N, the second frame N+1, the third frame N+2, the fourth frame N+3, the fifth frame N+4 and the sixth frame N+5 arranged in sequence) of the display apparatus 100 are shown. A curve rWT shows switching of the gamma curves of the watermark area Rwt, and a curve rNWT shows switching of the gamma curves of the non-watermark area Rnwt. In addition, as shown in cycle periods CY3 and CY4, the watermark area Rwt may be alternately driven by the gamma curves including the first gamma curve rA and the second gamma curve rB in three frame periods (for example, the first frame N, the second frame N+1, the third frame N+2), and the non-watermark area Rnwt may be alternately driven by the gamma curves including the first gamma curve rA and the second gamma curve rB in two frame periods (for example, the first frame N, and the second frame N+1).

Since a threshold of frequency perceived by human eyes is about 60 Hz, when bright and dark change frequency of the watermark area Rwt/non-watermark area Rnwt is greater than or equal to the threshold, the luminance perceived by the human eyes is an average result thereof and there is no flickering phenomenon, so that the differences between the two areas cannot be identified. However, when photographing with the photographic equipment, since a shutter is a fixed value, when a shutter time does not match a bright and dark period of the watermark area Rwt/non-watermark area Rnwt, the bright and dark difference between the watermark area Rwt/non-watermark area Rnwt may be photographed.

Since the threshold of frequency perceived by human eyes is about 60 Hz, when the cycle time of the watermark area Rwt and the non-watermark area Rnwt is less than or equal to 1/60 second, they are invisible to human eyes. In addition, when photographing with the photographic equipment, when the shutter time is the same as or a multiple of the cycle time of the watermark area Rwt and the non-watermark area Rnwt, the difference between the cycle time of the watermark area Rwt and the non-watermark area Rnwt cannot be photographed. For example, in the case where the frame update rate of the display module 120 is 120 Hz, and the cycle time=1/60 sec, the human eye perception is the average luminance of the watermark area Rwt/non-watermark area Rnwt. As a result, when the shutter of the photographic equipment is set at 1/60 sec (the fastest shutter speed), 1/30 sec, 1/15 see, . . . , the watermark effect cannot be photographed. But the slower the shutter is, the higher an exposure amount is, so that when the image is overexposed, it may also achieve the effect of preventing theft of secrets. Therefore, so that the fastest shutter speed that makes the photographic equipment unable to capture the difference between the two areas is the slower the better in the case that the human eyes cannot perceive.

FIG. 19 is a schematic diagram illustrating selection of asynchronous cycles of a watermark area and a non-watermark area of a display apparatus according to an embodiment of the invention. Referring to FIG. 18 and FIG. 19, as the fastest shutter speed under the common shutter speed that is unable to capture the watermark is the smaller the better, 1/15 sec is used as an example for illustration.

Since the threshold of frequency perceived by human eyes is about 60 Hz, a/R≤1/60 sec & b/R≤1/60 sec must be satisfied, where R is a frame update rate of the display module 120. Considering that a cycling frame number a of the watermark area Rwt>a cycling frame number b of the non-watermarking area Rnwt, the frame update rate of the display module 120 is R≥60×a. When the shutter of the photographic equipment is a multiple of a/R, the luminance of the photographed watermark area Rwt is constant; when the shutter of the photographic equipment is a multiple of b/R, the luminance of the photographed non-watermark area Rnwt is constant. Therefore, the conditions that the photographic equipment cannot capture the difference between the two areas are that the shutter speed is the least common multiple of a/R and b/R, and the constant luminance of the two areas are equal. Under multiple frequency combinations of the two areas, the fastest shutter speed of unable to capture the difference of the two areas≥the fastest shutter speed of the individual single frequency.

Considering that the cycling frame number a of the watermark area Rwt>the cycling frame number b of the non-watermarking area Rnwt (for example, the cycling frame number b of the non-watermarking area Rnwt=the cycling frame number a of the watermark area Rwt−1), the maximum value of the least common multiple that may be achieved is: when a=3, the frame update rate required by the display module 120 is 60×3=180 Hz, and the fastest shutter speed is 6/180=1/30 second; when a=4, the frame update rate required by the display module 120 is 60×4=240 Hz, and the fastest shutter speed is 12/240=1/20 second; when a=5, the frame update rate required by the display module 120 is 60×5=300 Hz, and the fastest shutter speed is 20/300=1/20 sec. It may be seen from a relationship between the frame update rate of the display module 120 (proportional to a) and the fastest shutter speed & exposure energy/unit frequency (normalized to 120 Hz), when a is greater than 7, improvement of the fastest shutter speed of the photographic equipment is slowed down, and increase of the exposure energy/unit frequency is slowed down, which is not in line with benefits, so that the cycling frame number a of the watermark area Rwt may be set between 4 and 6.

In the embodiment of the invention, the watermark area Rwt may be divided into more areas. Taking the division of two areas as an example, cycling frame numbers of a first area and a second area of the watermark area Rwt are respectively a1 and a2. Since the threshold of frequency perceived by human eyes is about 60 Hz, a1/R≤1/60 sec & a2/R≤1/60 sec & b/R≤1/60 sec must be satisfied. Considering a1≥a2≥b, the frame update rate of the display module 120 is R>60×a1. When the shutter of the photographic equipment is a multiple of a1/R, the luminance of the first area of the photographed watermark area Rwt is constant; when the shutter of the photographic equipment is a multiple of a2/R, the luminance of the second area of the photographed watermark area Rwt is constant; and when the shutter of the photographic equipment is a multiple of b/R, the luminance of the photographed non-watermark area Rnwt is constant. Therefore, the conditions that the photographic equipment cannot capture the difference of the three areas are that the shutter speed is the least common multiple of a1/R, a2/R and b/R, and the constant luminance of the three areas are equal.

Under multiple frequency combinations of the three areas, the fastest shutter speed of unable to capture the difference of the three areas≥the fastest shutter speed of the individual single frequency. Considering that a1≥a2≥b, when a=4, the least common multiple is 12, i.e., dividing into three areas and dividing into two areas (a=4) have the same benefits; when a1≥5, the least common multiple is 60, compared with the condition of dividing into two areas (a=5), dividing into three areas may greatly reduce the fastest shutter speed and increase the exposure energy/unit frequency. Therefore, when the watermark area Rwt is divided into more areas, the increase of the cycling frame number may greatly reduce the fastest shutter speed and increase the exposure energy/unit frequency.

Figure 20:
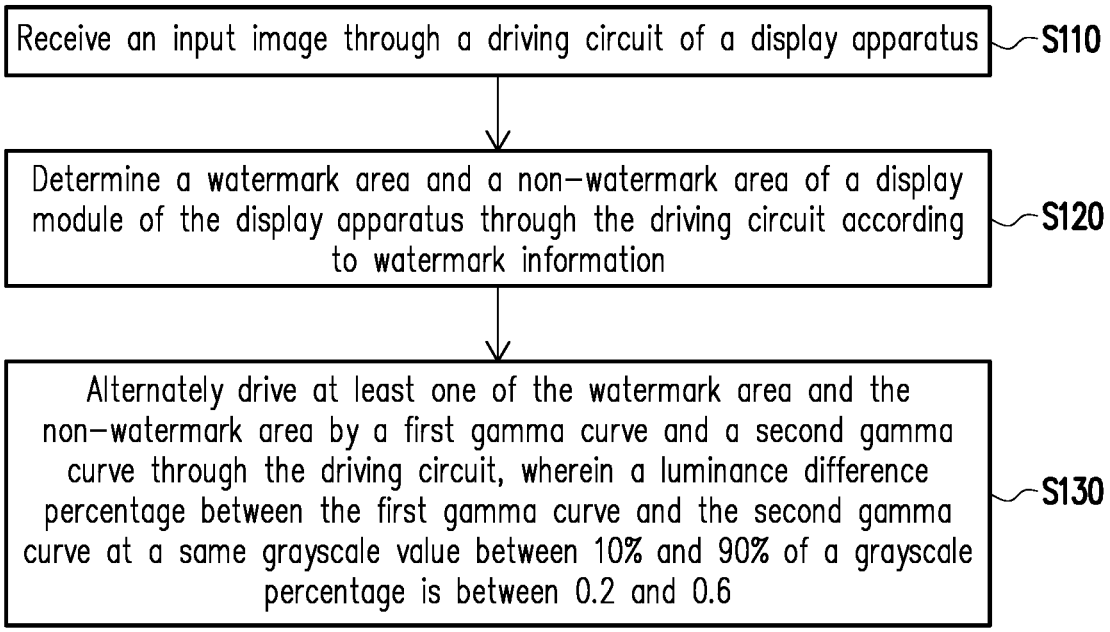
FIG. 20 is a flowchart of an image displaying method of a display apparatus according to an embodiment of the invention.

FIG. 20 is a flowchart of an image displaying method of a display apparatus according to an embodiment of the invention. Referring to FIG. 20, in the embodiment, the image displaying method of the display apparatus includes following steps. In step S110, an input image is received through a driving circuit of the display apparatus. In step S120, a watermark area and a non-watermark area of a display module of the display apparatus are determined by the driving circuit according to watermark information. In step S130, at least one of the watermark area and the non-watermark area is alternately driven by a first gamma curve and a second gamma curve through the driving circuit, where a luminance difference percentage of the first gamma curve and the second gamma curve at a same grayscale value between 10% and 90% of a grayscale percentage is between 0.2 and 0.6. The sequence of the steps S110, S120, and S130 is for illustration, and the embodiment of the invention is not limited thereto. In addition, for details of the steps S110, S120, and S130, reference may be made to the embodiments shown in FIG. 1 to FIG. 19, which are not repeated.

In summary, in the display apparatus and the image displaying method according to the embodiments of the invention, at least one of the watermark area and the non-watermark area is driven alternately by the first gamma curve and the second gamma curve. The luminance difference percentage between the first gamma curve and the second gamma curve at the same grayscale value between 10% and 90% of the grayscale percentage is between 0.2 and 0.6. Since human eye perception is equivalent to the luminance integrator, the human eyes may view an image with an intermediate luminance, and photographic equipment with a fast shutter may obviously capture the image. In this way, the watermark to which the human eyes are insensitive but is clear to photographic equipment may be displayed on the display module 120.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A display apparatus, comprising:

a display module; and a driving circuit, coupled to the display module and receiving an input image, wherein the driving circuit determines a watermark area and a non-watermark area of the display module according to watermark information, and at least one of the watermark area and the non-watermark area is alternately driven by a first gamma curve and a second gamma curve, wherein a luminance difference percentage between the first gamma curve and the second gamma curve at a same grayscale value between 10% and 90% of a grayscale percentage is between 0.2 and 0.6.

2. The display apparatus according to claim 1, wherein the watermark area has a first red sub-pixel group, a first green sub-pixel group, and a first blue sub-pixel group, and the non-watermark area has a second red sub-pixel group, a second green sub-pixel group, and a second blue sub-pixel group.

3. The display apparatus according to claim 2, wherein both the watermark area and the non-watermark area are alternately driven by the first gamma curve and the second gamma curve.

4. The display apparatus according to claim 3, wherein during a first frame period, at least the first red sub-pixel group in the first red sub-pixel group, the first green sub-pixel group, and the first blue sub-pixel group is driven by the first gamma curve, and at least the second red sub-pixel in the second red sub-pixel group, the second green sub-pixel group, and the second blue sub-pixel group is driven by the second gamma curve, wherein during a second frame period following the first frame period, at least the first red sub-pixel group in the first red sub-pixel group, the first green sub-pixel group, and the first blue sub-pixel group is driven by the second gamma curve, and at least the second red sub-pixel in the second red sub-pixel group, the second green sub-pixel group, and the second blue sub-pixel group is driven by the first gamma curve.

5. The display apparatus according to claim 2, wherein the watermark area is alternately driven by the first gamma curve and the second gamma curve, and the non-watermark area is driven by a third gamma curve, wherein the third gamma curve is between the first gamma curve and the second gamma curve.

6. The display apparatus according to claim 5, wherein during a first frame period, at least the first red sub-pixel group in the first red sub-pixel group, the first green sub-pixel group, and the first blue sub-pixel group is driven by the first gamma curve, wherein during a second frame period following the first frame period, at least the first red sub-pixel group in the first red sub-pixel group, the first green sub-pixel group, and the first blue sub-pixel group is driven by the second gamma curve.

7. The display apparatus according to claim 5, wherein the first gamma curve, the second gamma curve, and the third gamma curve are not overlapped at the grayscale percentage of 100%.

8. The display apparatus according to claim 5, wherein a luminance difference percentage between the first gamma curve and the third gamma curve at the same grayscale value between 10% and 90% of the grayscale percentage is between 0.2 and 0.6, and a luminance difference percentage of the second gamma curve and the third gamma curve at the same grayscale value is between 0.2 and 0.6.

9. The display apparatus according to claim 1, wherein the first gamma curve and the second gamma curve are not overlapped at the grayscale percentage of 100%.

10. The display apparatus according to claim 1, wherein the watermark area is alternately driven frame-by-frame periodically by a plurality of gamma curves comprising the first gamma curve and the second gamma curve in a frame periods, and the non-watermark area is alternately driven frame-by-frame periodically by the gamma curves in a-1 frame periods.

11. The display apparatus according to claim 10, wherein a is between 4 and 6.

12. An image displaying method of a display apparatus, comprising:

receiving an input image through a driving circuit of the display apparatus;

determining a watermark area and a non-watermark area of a display module of the display apparatus through the driving circuit according to watermark information; and alternately driving at least one of the watermark area and the non-watermark area by a first gamma curve and a second gamma curve through the driving circuit, wherein a luminance difference percentage between the first gamma curve and the second gamma curve at a same grayscale value between 10% and 90% of a grayscale percentage is between 0.2 and 0.6.

13. The image displaying method according to claim 12, wherein the watermark area has a first red sub-pixel group, a first green sub-pixel group, and a first blue sub-pixel group, and the non-watermark area has a second red sub-pixel group, a second green sub-pixel group, and a second blue sub-pixel group.

14. The image displaying method according to claim 13, further comprising:

alternately driving both the watermark area and the non-watermark area by the first gamma curve and the second gamma curve through the driving circuit.

15. The image displaying method according to claim 14, further comprising:

during a first frame period, driving at least the first red sub-pixel group in the first red sub-pixel group, the first green sub-pixel group, and the first blue sub-pixel group by the first gamma curve, and driving at least the second red sub-pixel in the second red sub-pixel group, the second green sub-pixel group, and the second blue sub-pixel group by the second gamma curve; and during a second frame period following the first frame period, driving at least the first red sub-pixel group in the first red sub-pixel group, the first green sub-pixel group, and the first blue sub-pixel group by the second gamma curve, and driving at least the second red sub-pixel in the second red sub-pixel group, the second green sub-pixel group, and the second blue sub-pixel group by the first gamma curve.

16. The image displaying method according to claim 13, further comprising:

through the driving circuit, alternately driving the watermark area by the first gamma curve and the second gamma curve, and driving the non-watermark area by a third gamma curve, wherein the third gamma curve is between the first gamma curve and the second gamma curve.

17. The image displaying method according to claim 16, further comprising:

during a first frame period, driving at least the first red sub-pixel group in the first red sub-pixel group, the first green sub-pixel group, and the first blue sub-pixel group by the first gamma curve, and during a second frame period following the first frame period, driving at least the first red sub-pixel group in the first red sub-pixel group, the first green sub-pixel group, and the first blue sub-pixel group by the second gamma curve.

18. The image displaying method according to claim 12, wherein the first gamma curve and the second gamma curve are not overlapped at the grayscale percentage of 100%.

19. The image displaying method according to claim 12, further comprising:

alternately driving the watermark area frame-by-frame periodically by a plurality of gamma curves comprising the first gamma curve and the second gamma curve in a frame periods through the driving circuit; and alternately driving the non-watermark area frame-by-frame periodically by the gamma curves in a-1 frame periods through the driving circuit.

20. The image displaying method according to claim 19, wherein a is between 4 and 6.

* * * * *